US012799739B2

(12) United States Patent
Neto

(10) Patent No.: US 12,799,739 B2
(45) Date of Patent: Nov. 17, 2026

(54) INTELLIGENT PROTECTOR FOR STRETCHING ROPES WITH POWER CUT-OFF AND LOCATOR FOR A HYDRAULIC JACK AND USE THEREOF

(71) Applicant: EVEHX ENGENHARIA LTDA, Araucaria (BR)

(72) Inventor: Ernani Alves Neto, Curitiba (BR)

(73) Assignee: EVEHX ENGENHARIA LTDA, Araucaria (BR)

( * ) Notice: Subject to any disclaimer, the term of this patent is extended or adjusted under 35 U.S.C. 154(b) by 119 days.

(21) Appl. No.: 18/726,222

(22) PCT Filed: Jan. 5, 2022

(86) PCT No.: PCT/BR2022/050003
§ 371 (c)(1),
(2) Date: Jul. 2, 2024

(87) PCT Pub. No.: WO2023/130164
PCT Pub. Date: Jul. 13, 2023

(65) Prior Publication Data

US 2025/0116112 A1 Apr. 10, 2025

(51) Int. Cl.
*E04C 5/00* (2006.01)
*E04C 5/08* (2006.01)

(52) U.S. Cl.
CPC ..... *E04C 5/08* (2013.01)

(58) Field of Classification Search
CPC ... E04C 5/08; E04C 5/122; E04C 5/12; E04C 3/10; E04C 5/10; E04C 5/085
USPC ..... 173/20
See application file for complete search history.

(56) References Cited

U.S. PATENT DOCUMENTS 5,353,014 A * 10/1994 Carroll ..... H01H 71/04 340/638
5,624,237 A * 4/1997 Prescott ..... E03B 11/00 361/25
5,918,180 A * 6/1999 Dimino ..... B60R 25/102 340/988

(Continued)

FOREIGN PATENT DOCUMENTS

CN 208486163 U 2/2019
KR 101775627 B1 * 9/2017 ..... E01D 19/16

OTHER PUBLICATIONS

International Search Report, National Institute of Industrial Property, Sep. 22, 2022.

*Primary Examiner* — Jacob A Smith
(74) *Attorney, Agent, or Firm* — Bay State IP, LLC

(57) ABSTRACT

The present disclosure relates to an intelligent protector for stretching ropes in the prestressing process, having a power cut-off and a locator for a hydraulic jack, as well as to the use thereof. The present utility model patent application is applicable to the field of civil construction, especially to assistance during prestressing. The present invention streamlines the prestressing process by informing the operator of the maximum and minimum opening limit of the pistons, thus protecting the equipment, increasing its useful life, and avoiding breakages mid-operation. The invention also protects the operator from potential overload that can damage the equipment and put the operator at risk of injury.

3 Claims, 2 Drawing Sheets

(56) References Cited

U.S. PATENT DOCUMENTS

Figure 1:
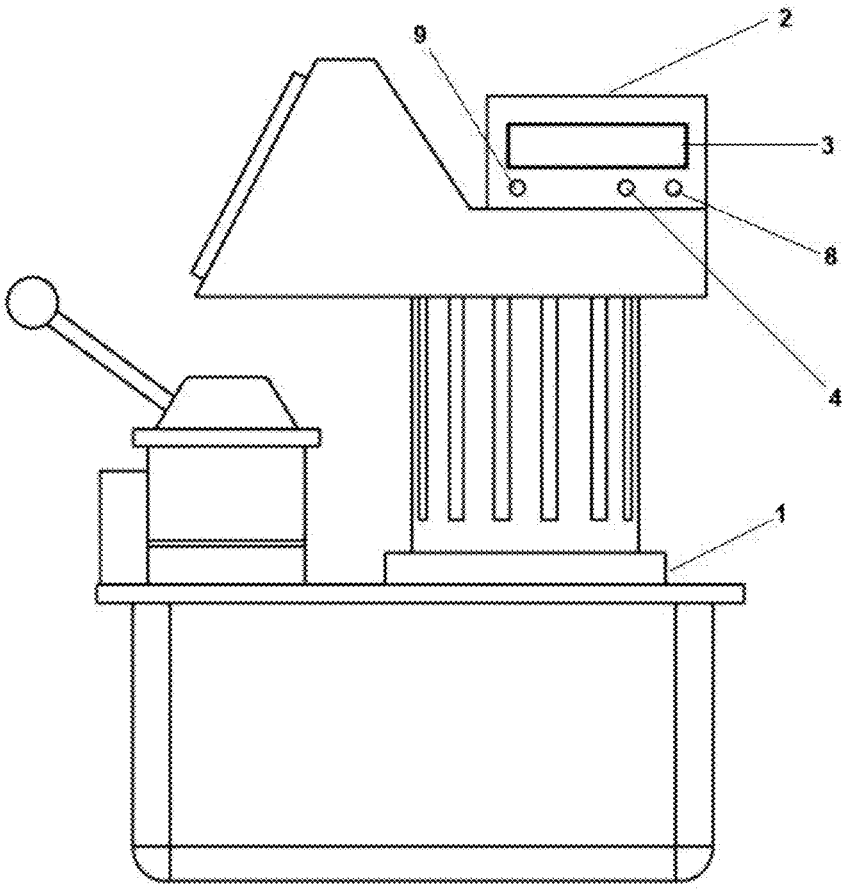

| | | | | |
|---|---|---|---|---|
| 2015/0066312 | A1* | 3/2015 | Sakuda | E02F 3/435 701/50 |
| 2016/0123356 | A1* | 5/2016 | Jirgal | F15B 15/2884 73/168 |
| 2016/0274001 | A1 | 9/2016 | Lin | |

* cited by examiner

INTELLIGENT PROTECTOR FOR STRETCHING ROPES WITH POWER CUT-OFF AND LOCATOR FOR A HYDRAULIC JACK AND USE THEREOF

CROSS REFERENCE TO RELATED APPLICATION

This application is for entry into the U.S. National Phase from which priority is claimed under all applicable sections of Title 35 of the United States Code including, but not limited to, Sections 120, 363, and 365(c) to International Application No. PCT/BR2022/050003 filed on Jan. 5, 2022, the contents of which are incorporated by reference herein in its entirety as part of the present application.

The present utility model patent application relates to an intelligent protector for stretching ropes in the prestressing process, having a power cut-off and a locator for a hydraulic jack, as well as to its use.

FIELD OF APPLICATION OF THE INVENTION

The present application for a utility model patent applies to the field of Civil Construction, especially in the aid during prestressing.

STATE OF THE TECHNIQUE

The application of greased strands in slabs has been the structural solution that has shown the greatest growth in recent times. Although some structures with prestressed slabs were first implemented in Europe, the real development of these structures took place in the USA and it can grow much more through the greater dissemination of this application among professionals in the field, especially those who have not yet had contact with prestressing.

Patent application BR 102019020121-5 A2 titled "CONSTRUCTION SYSTEM FOR ASSEMBLY, ASSEMBLY CHECK AND CHECK OF EXTENSIONS OF GREASED STRANDS IN CIVIL CONSTRUCTION" comprises a set of steps for marking greased strands, assembling greased strands, verifying the parabolic trace of the greased strands, and corresponding checking with project data, either to release the floor for concreting or to verify the extensions of the strands after prestressing. The application includes a system for marking prestressing strands (1) and their supports (2) through coded tags (3 and 4) that are present in both parts with the adoption of intermediate tags (5) to determine the center of the distance between the support positions. An equipment (6) reads and verifies real data comparing it with project data; a computerized system for image reading and checking technical details specified by designers such as the parabolic traces of the strands as foreseen in projects, the quantity and distribution of strands in the structure, supports used to support the strand; an accessory (7) measures the theoretical extensions of the strands after prestressing; and issues partial and final reports of data verification. This application is situated in the field of civil construction, specifically the construction of prestressed concrete structures using greased strands for prestressing.

Patent application BR 102017013756-2 A2 titled "MARKING SYSTEM FOR GREASED STRANDS FOR CONSTRUCTION OF PRESTRESSED CONCRETE STRUCTURES" refers to a "MARKING SYSTEM FOR GREASED STRANDS FOR CONSTRUCTION OF PRESTRESSED CONCRETE STRUCTURES" comprising three markings with symbols and numbers printed on the strand cover, including: a) cable height dimension; b) length scale; and c) standard marking every 10 cm, as well as the marking and cutting machine for prestressing cables.

The application field of this request is civil construction, specifically the construction of prestressed concrete structures. As known to those skilled in the art of constructing prestressed concrete structures, there is no industrial marking system for prestressing cables on the market, which is why this patent application is claimed. In prestressed concrete structures, prestressing cables are positioned as a parabola where the ends are higher, and the central part is lower so that when tensioned they produce positive force vectors in the structure to span larger gaps between pillars. To position the prestressing cables in a parabolic configuration, it is necessary to place supports with different heights along their length, with the supports closest to the cable ends being higher than the supports placed in the intermediate portion of said cables.

OBJECTIVE OF THE INVENTION

The objectives of the present utility model patent application include:

- Preventing the operator of the hydraulic jack from applying load at the end of the equipment's stroke;
- Discovering where the equipment was used and seeing its location in real-time;
- Collecting information about the equipment.

Advantages of the Invention

Advantages of the invention include increased equipment life, enhanced operator protection, and the ability to gather information about the equipment's use, allowing for productivity assessment and preventive maintenance planning.

DETAILED DESCRIPTION OF THE INVENTION AND ITS FIGURES

The present utility model patent application refers to an intelligent protector for stretching ropes during the prestressing process.

FIG. 1 shows the motor set (jack)/hydraulic pump (1), the case with hardware (2) where the device (not shown) is located inside, and an LCD display (3) which, when opening and closing the case (2), shows the distance on the LCD display (3) and the button (4) that, when the distance limit is reached, the device will cut the power. To release the power, the user will have to manually press the button (4).

Figure 2:
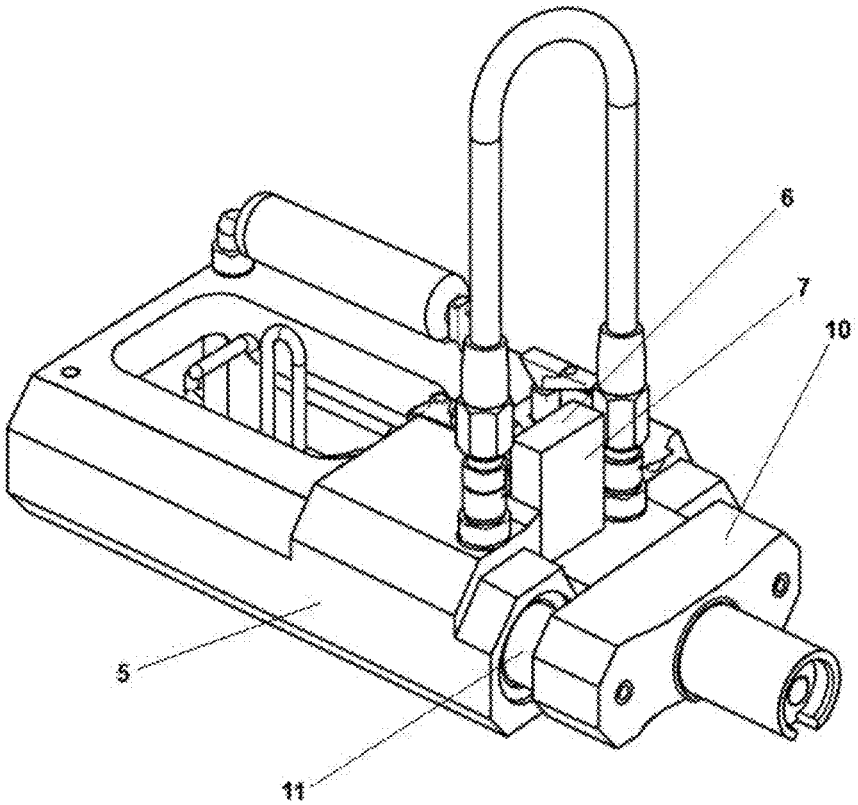

FIG. 2 refers to the hydraulic jack (5) where the ultrasonic sensor (6) is located, which measures the opening and closing distance of the equipment. On the reference plate (7), when the hydraulic jack tip (10) opens, the reference plate (7) opens together and is in front of the ultrasonic sensor (6) which measures the distance and shows it on the LCD display (3) of FIG. 1.

The present utility model patent application refers to the intelligent protector comprising: the case with hardware (2) where the device (not shown) that collects data and controls the project sensors and modules is located inside; the relay module, which, through a signal received from the case with hardware (2), releases or cuts the electrical current of the hydraulic pump; the ultrasonic sensor (6) that reads the distance concerning a plate (7) coupled to the hydraulic jack tip (10), thus measuring the opening and closing of the hydraulic jack pistons (11); the buzzer (not shown) that makes a sound signal when the opening or closing limit of the hydraulic jack pistons (11) is exceeded; the LCD display (3) that informs the distance of the hydraulic jack pistons (11); the GPS module (not shown) that captures the time and location of the equipment; the memory card module (not shown) that records the usage data of the set, such as its location.

The present invention streamlines the prestressing process by informing the operator of the maximum and minimum opening limit of the pistons, thus protecting the equipment, increasing its useful life, and avoiding breakages mid-operation.

The invention also protects the operator from possible overload that can damage the equipment and put the operator at risk of injury.

With the ultrasonic sensor (6) installed on the hydraulic jack (5), it observes the displacement of a plate (7) or any other reference installed on the jack tip (5). When the equipment (1) is used, it shows the distance that the pistons have already opened on the LED display, lighting a green LED (button (4)). Once the operator exceeds the pre-established distance, the microcontroller sends a signal that activates the relay, cutting the electrical current of the system, activates a buzzer that emits a sound signal, and activates a red LED (8). There is also a button (9) that, when pressed, releases the system current (9), allowing the operator to advance or retract the piston.

The readings taken by the ultrasonic sensor (6) are recorded on a memory card installed in the microcontroller.

Additionally, the present invention uses a GPS module (not shown) that is located together with the microcontroller, informing the equipment's location and recording the coordinate information on a memory card.

The present invention uses a programming language in the microcontroller that executes the entire system.

The system not only measures the electrical current but also cuts it from the hydraulic jack and hydraulic pump set (1).

The invention claimed is:

1. An intelligent protector for stretching ropes with power cut-off and locator for a hydraulic jack, comprising:

a motor set including a hydraulic jack and hydraulic pump;

an LCD display that shows a distance when pistons are opening and closing;

a button that cuts a current when a distance limit is exceeded, requiring manual action to release the current;

an ultrasonic sensor located on the hydraulic jack that measures an opening and closing distance of equipment;

a reference plate that moves with a hydraulic jack tip, positioned in front of the ultrasonic sensor to measure the distance to be displayed on the LCD display.

2. The intelligent protector of claim 1, wherein:

the ultrasonic sensor installed on the hydraulic jack observes a displacement of the reference plate or any other reference installed on the hydraulic jack tip;

the equipment shows the distance that the pistons have already opened on the LCD display, lighting a green LED;

once an operator exceeds a pre-established distance, a signal is transmitted to a relay, cutting the current, activating a buzzer, and lighting a red LED;

a button is provided to release a system current, allowing the operator to advance or retract the pistons.

3. The intelligent protector of claim 1, wherein the protector is used in the stretching of ropes during a prestressing process.

* * * * *